US007426756B2

(12) United States Patent
Clark

(10) Patent No.: US 7,426,756 B2
(45) Date of Patent: Sep. 23, 2008

(54) ADJUSTABLE TOILET BOWL

(76) Inventor: Moses Clark, 300 Yoakum Pkwy., #1522, Alexandria, VA (US) 22304

( * ) Notice: Subject to any disclaimer, the term of this patent is extended or adjusted under 35 U.S.C. 154(b) by 267 days.

(21) Appl. No.: 11/471,962

(22) Filed: Jun. 21, 2006

(65) Prior Publication Data

US 2007/0151012 A1 Jul. 5, 2007

(30) Foreign Application Priority Data

Jul. 28, 2005 (PL) ..... 376352

(51) Int. Cl.
*E03D 11/00* (2006.01)

(52) U.S. Cl. ..... 4/420; 4/252.2

(58) Field of Classification Search ..... 4/420, 4/252.1–252.2, 667
See application file for complete search history.

(56) References Cited

U.S. PATENT DOCUMENTS 3,914,806 A * 10/1975 Pearce ..... 4/254
4,168,552 A * 9/1979 Austin ..... 4/667
4,174,546 A * 11/1979 Ohtake ..... 4/420
4,441,218 A * 4/1984 Trybom ..... 4/252.2
4,726,079 A * 2/1988 Signori et al. ..... 4/420
5,063,617 A * 11/1991 Ward et al. ..... 4/667
5,199,113 A * 4/1993 Glasow et al. ..... 4/252.2
6,553,582 B1 * 4/2003 Clark ..... 4/252.2
2003/0074731 A1 * 4/2003 Sumino ..... 4/667

* cited by examiner

*Primary Examiner*—Charles E Phillips
(74) *Attorney, Agent, or Firm*—Perman & Green, LLP

(57) ABSTRACT

The subject of the invention concerns an adjustable toilet bowl for public usage,which enables the free regulation of the height of the bowl with respect to the floor.

Figure 1:
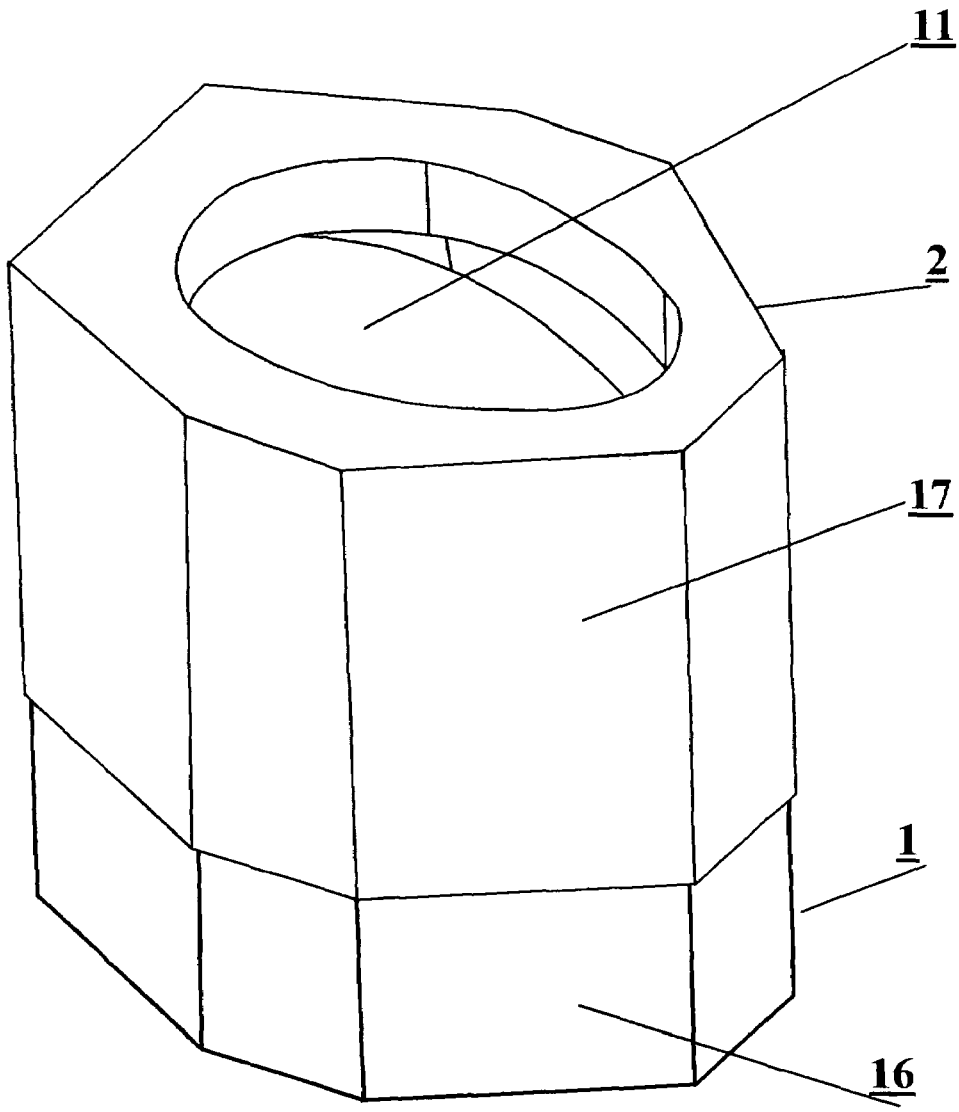

The toilet bowl is composed of two elements, lower (1) and upper (2). These elements are joined, sliding way, with vertical screws (5) and sleeves with internal thread (14). Screws (5) mounted in the lower element (1), are ended from the bottom with drive element (6) and are fixed by rotary motion to flat bars (4) and (7), to which a flat bar (8) with motor (9) and gear wheel (10) is fixed permanently. Drive elements (6) and (10) are set on the same level. The upper element (2) has an optionally profiled pan (11), permanently joined with a sewage discharge pipe (12), and to the inner upper surface (13) of the upper element (2), sleeves (14) ended with an opening (15) are installed.

3 Claims, 4 Drawing Sheets

ADJUSTABLE TOILET BOWL

CROSS-REFERENCE TO RELATED APPLICATIONS

This application claims priority from Polish Patent Application No. P-376352, filed on Jul. 28, 2005.

The subject of the invention concerns an adjustable toilet bowl for public usage, which enables the free regulation of the height of the bowl with respect to the floor.

The adjustable toilet bowl is intended for the physically handicapped, in particular for persons with motor handicaps, persons undergoing convalescence following various types of operations or surgical procedures, and also for overweight and physically atypical persons.

There exist many bowls intended for usage by the physically handicapped or by overweight persons, who find it very difficult to proceed from a standing position to a sitting position. These bowls are usually fitted with rails only, which allow the user to support himself/herself. There also exist bowls that are fitted with a platform that lifts the user, while others may be lifted and lowered. The disadvantage of these solutions is their limited scope of usage, the fact that they require the installation of numerous supports and rails (which provide support to the user), and also that they do not solve the problem of independent usage of the bowl by a handicapped person—in particular if the potential user is unable to stand by himself/herself or cannot maintain a stable standing position.

U.S. Pat. No. 6,553,582 refers to an adjustable toilet bowl system. It comprises the following parts: a clean water tank; a sewage pipe fixed to the floor; a toilet bowl fitted with a clean water inlet and used water outlet; a flexible clean water conduit, which flexibly joins the clean water tank with the toilet bowl inlet; a flexible used water conduit, which flexibly joins the toilet bowl outlet with the sewage pipe; a system which supports the toilet bowl and comprises a few separately adjusted supports of the toilet bowl, each of which is attached by one end to the floor and by the other to the toilet bowl; a control system for these supports, which is separately connected to each support in order to move them independently of each other and thus move the toilet bowl in numerous planes and tilt it with respect to the floor at any angle.

The disadvantage of this bowl, covered by U.S. Pat. No. 6,553,582, is the limited height to which the bowl may be raised by its hydraulic supports. In addition, the support structures are exposed to considerable overloads, resulting from the necessity of moving the bowl from its tilted position, together with the user, forward to a horizontal position, in order for the person to use the bowl. Another disadvantage of this toilet bowl is the fact that it does not adapted to a horizontal outlet of used water, connected by a flexible extendible conduit to the sewage pipe located vertically in the rear wall of the toilet.

For many handicapped persons, and in particular for physically handicapped persons or ones suffering from considerable overweight, usage of the toilet bowl is a difficult—or often even impossible—task.

The adjustable toilet bowl constituting the subject of the invention is fitted with a clean water inlet connected with a clean water tank by a flexible concertina-type conduit, and a used water outlet connected by a flexible concertina-type conduit with a used water discharge pipe. The clean water tank may be installed directly on the rear part of the bowl, on the wall of the toilet, or even within the wall. Used water is discharged through a horizontal outlet in the rear part of the bowl or through a vertical outlet installed in the bottom part of the bowl. The bowl is made up of two basic elements. These are the lower element, which is set on the floor, and an upper element, which is placed on the lower element.

The lower element of the bowl—fixed to the floor—constitutes a stable and durable base for the upper element, which is the usable element of the bowl. Within the lower element there is installed a mechanical system for lowering and lifting the bowl. This system comprises at least two screws and a drive mechanism. In the lower part, these screws are fitted with a fixed element which sets them in rotary motion. Advantageously, this element is a gear wheel. In order to ensure the efficient lifting and lowering of the upper element of the bowl, it would be advantageous for the screws installed in the lower element to have a structure in the form of an elongated sleeve, into which a screw with a left-hand thread would be introduced at one end and a screw with a right-hand thread at the other. Each sleeve has an internal thread, which facilitates the screwing in and out of screws. The rotary motion of the sleeve allows the simultaneous extension and retraction of two screws from its openings, with the directions of extension and retraction thereof being opposite with respect to the sleeve. These sleeves are fitted with fixed elements that set them in rotary motion. Advantageously, this element is a gear wheel. A screw of this type makes it possible to increase the lifting height of the upper bowl element in a stable manner.

The drive mechanism, which provides the upper element of the bowl with a sliding upwards and downwards movement, is installed in the lower element of the bowl. The drive mechanism comprises an electric motor powered by electricity with a safe voltage for users of the bowl, the value of which does not exceed 24 V, and a flexible cogbelt or chain. The chain used in the drive mechanism should be constructed in such a way as to ensure its trouble-free horizontal operation. Working through a transmission, the electric motor powers a flexible drive belt, the motion of which is converted to the simultaneous rotary motion of all the screws installed in the lower element or the sleeves installed on the screws with left-hand or right-hand threads. Depending on the direction of motion of the flexible belt, the sleeves set the screws which lift or lower the upper element of the bowl in left-hand or right-hand motion.

The upper element of the bowl houses the pan proper, with a freely profiled shape. In the rear of the pan there is an opening through which clean water runs and flushes the bowl. In the lower part of the pan there is an opening through which sewage is discharged from the pan. This opening is connected with an air-trap that protects against unpleasant smells. On the other side, the air-trap is connected through a horizontal pipe with the external flexible concertina-type conduit that channels sewage away from the rear part of the bowl. The air-trap may also be connected with a vertical pipe which ends in a vertical flexible concertina-type conduit that channels sewage directly to vertical sewage conduits located in the floor under the bowl. Within the upper element there are installed at least two sleeves, which are set in the same way as the screws in the bottom element of the bowl. The inside walls of the sleeves are threaded, which makes it possible to insert screws therein from the bottom element of the bowl.

The upper element of the bowl is set in motion by the system which controls the activation and deactivation of the motor and transmission. Once activated, the engine allows movement of the drive belt that provides rotary screw movement in two directions, resulting in the lowering or lifting of the upper element of the bowl. The drive mechanism of the bowl may be controlled through a cable connection or a wireless link, utilising a so-called remote control system.

An advantage of the toilet bowl constituting the subject of the invention is its stable construction, which ensures safe utilisation of the bowl by any user. In addition, the bowl constituting the subject of the invention ensures safe and easy usage by the physically handicapped. The fact that the height of the seat may be set freely with respect to the floor means that the bowl may be used by both very tall and very short persons. The flexible concertina-type conduit facilitates unlimited movement of the bowl, and its length is selected in such a way that it does not hang loosely and thereby hamper the flow of water. The application of a concertina-type conduit for the inflow of clean water to the bowl and the outflow of used water also serves to improve the aesthetics of the toilet cubicle.

Figure 2:
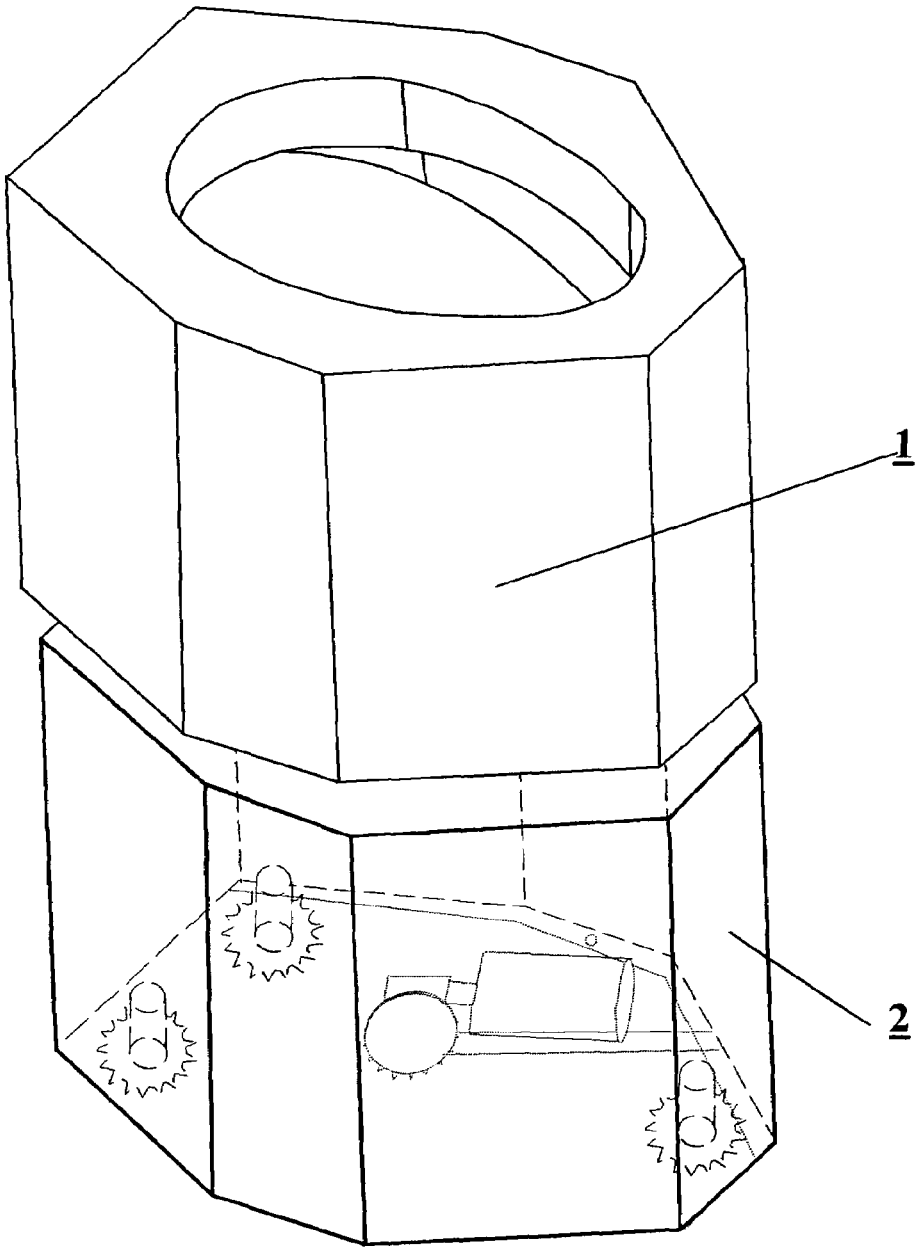
Figure 3:
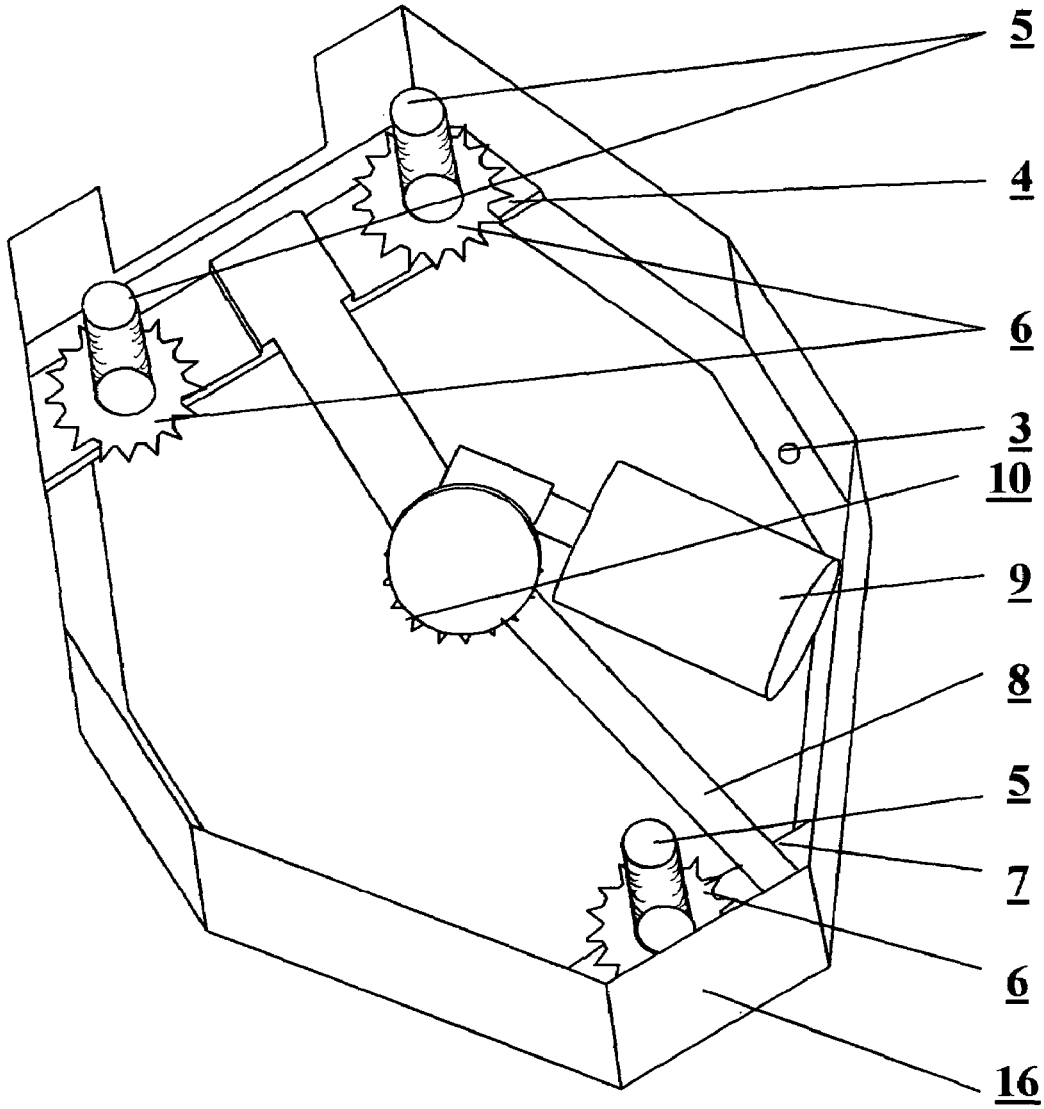
Figure 4:
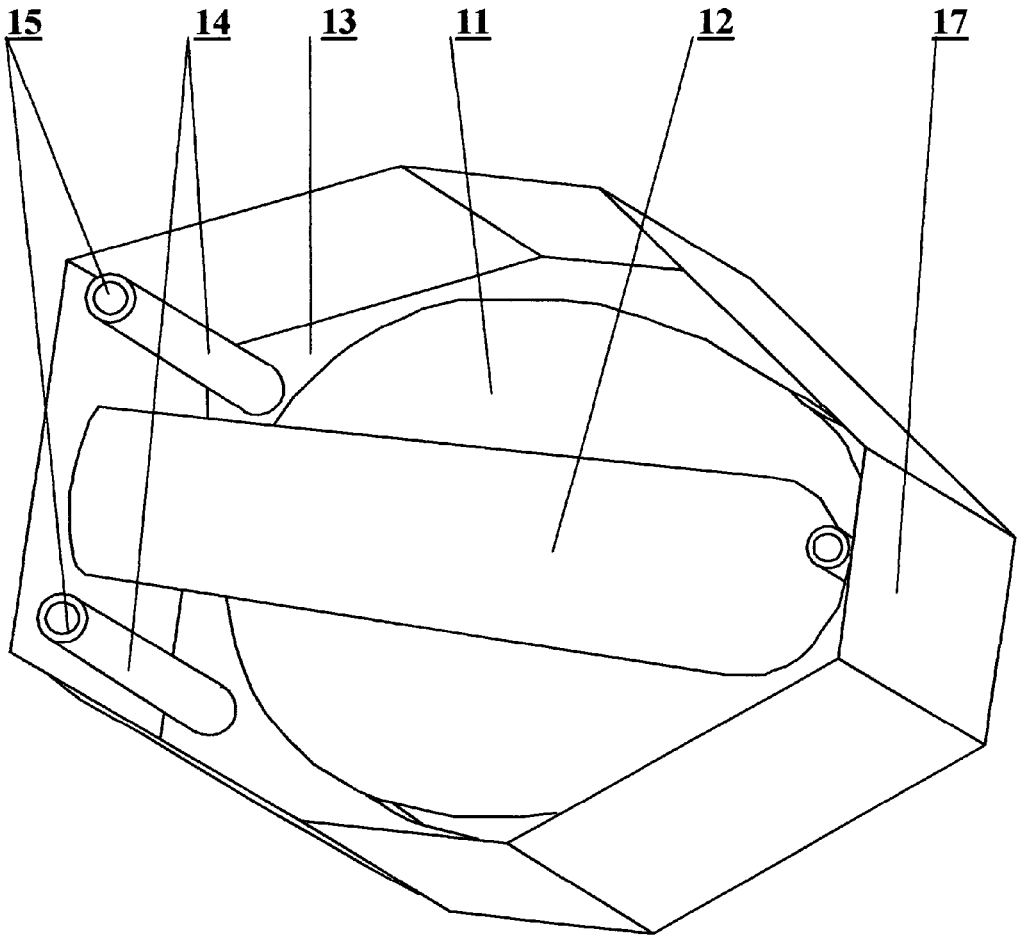

The subject of the invention has been presented in the form of a construction diagram, where FIG. 1 is an axonometric view of the bowl, FIG. 2 shows the bottom and upper elements of the bowl prior to installation, FIG. 3 is a top view of the bottom element, and FIG. 4 is a bottom view of the upper element.

The lower element 1 of the toilet bowl constituting the subject of the invention has openings 3 for screws fixing it to the floor. In the bottom rear part of element 1, along the entire width of the rear wall of the bowl, there is installed a set flat bar 4, on which there are pivot-mounted two screws 5 with a gear wheel 6 fixed permanently to the bottom thereof. In the bottom front part of element 1, along the entire width of the front wall of the bowl, there is installed a set flat bar 7, on which there is pivot-mounted a screw 5 with a gear wheel 6 fixed permanently to the bottom thereof. All of the gear wheels 6 are installed on one level. The flat bars 4 and 7 constitute a support structure for the flat bar 8, to which there is attached an electric motor 9 with a transmission that transfers the rotary motion of the motor to the gear wheel 10. The gear wheel 10 is set on the same level as the gear wheels 6. The upper element 2 of the bowl constituting the subject of the invention has a profiled pan 11, which has a sewage discharge pipe 12 permanently fixed thereto. Sleeves 14 terminating in an opening 15 are installed on the inner upper surface 13 of the upper element 2. The bottom element 1 is fitted with a housing 16. The upper element 2 is fitted with a housing 17.

The invention claimed is:

1. Adjustable toilet bowl, comprising a pan set on the floor, fitted with a clean water inlet and used water outlet, flexible used water conduit, separately adjusted lateral supports and a rear support, and a control system for these supports, significant in that it is made of two elements, a bottom (1) and an upper (2) element, which are connected with each other in a sliding manner, at least by two vertical screws (5) and sleeves with an internal thread (14), whereas the screws (5) are set in the bottom element (1), end in a drive element (6), and are fastened by pivots to flat bars (4) and (7), to which there is permanently fixed a flat bar (8) with a motor (9) and a drive element (10), whereas drive elements (6) and (10) are set on one level, while the upper element (2) has a freely profiled pan (11) that is permanently attached to a sewage discharge pipe (12), while sleeves (14) terminating in an opening (15) are installed on the inner upper surface (130 of the upper element (2).

2. The toilet bowl as per claim 1, wherein the drive elements (6) and (10) are gear wheels.

3. The toilet bowl as per claim 1, each screw (5) has a structure in the form of an elongated sleeve, into which a screw with a left-hand thread is introduced at one end and a screw with a right-hand thread at the other, whereas each sleeve has an internal thread and a permanently installed drive element (6).

* * * * *